US006293815B1

(12) United States Patent
Daoud

(10) Patent No.: US 6,293,815 B1
(45) Date of Patent: Sep. 25, 2001

(54) CONNECTOR HAVING SELF-SEALING MEMBRANE

(75) Inventor: Bassel H. Daoud, Parsippany, NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/216,999

(22) Filed: Dec. 21, 1998

(51) Int. Cl.[7] ..... H01R 4/24; H01R 4/26; H01R 11/20

(52) U.S. Cl. ..... 439/426; 439/912

(58) Field of Search ..... 439/400, 426, 439/436, 441, 629, 633, 912

(56) References Cited

U.S. PATENT DOCUMENTS 3,127,230 * 3/1964 Marquis et al. ..... 439/178
3,571,779 * 3/1971 Collier ..... 439/587
3,885,850 * 5/1975 Witte et al. ..... 439/346
4,722,579 * 2/1988 Cummings et al. ..... 439/391
4,971,567 * 11/1990 Mizuno et al. ..... 439/98
4,978,315 * 12/1990 Edgley et al. ..... 439/441
5,484,304 * 1/1996 Capper et al. ..... 439/409

* cited by examiner

*Primary Examiner*—Neil Abrams
*Assistant Examiner*—Michael C. Zarroli
(74) *Attorney, Agent, or Firm*—Stroock & Stroock & Lavan LLP

(57) ABSTRACT

A connector includes a housing having a test channel, a terminal strip having a portion disposed within the test channel, and a membrane attached to the housing and over one end of the test channel to substantially seal the test channel from outside contaminants before, during and after testing of the connector. The membrane may be affixed to the housing, inserted into the test channel, or formed with the test channel.

16 Claims, 4 Drawing Sheets

CONNECTOR HAVING SELF-SEALING MEMBRANE

FIELD OF THE INVENTION

This invention relates to the field of telephone wire connector blocks and distribution systems, and specifically to a tool for piercing the cap of a connector to provide a test channel for testing wiring connected to the connector and a connector cap for resealing the connector.

BACKGROUND OF INVENTION

In a telephone network, a network cable from the central office is connected to a building entrance protector (BEP) located at the customer site, where the individual telephone lines are broken out line-by-line. The network cable, which consist of a plurality of tip-ring wire pairs that each represent a telephone line, is typically connected to a connector block that forms a part of the BEP. Such connectors may be, for example, mini-rocker, tool-less-insulation-displacement (IDC)-type connectors, such as, for example, those sold by A. C. Egerton, Ltd. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971.

The customer telephone equipment is coupled through such an IDC connector to, for example, a central office telephone line. The mini-rocker connector generally has a top section that includes two wire insertion holes and a bottom section that houses a pair of terminal strips. The wire insertion holes each accommodate one wire of a tip-ring wire pair. The top section pivots about a generally hinged fixed axis located on the side opposite the wire insertion holes and has a movable latch for maintaining the top section in its closed position.

To open the top section, a user releases the latch member and pivots the top section to its open position. When the top section is in its open position, the terminal strips do not intersect the wire insertion holes, but when the top section is in its closed position, the terminal strips intersect the wire insertion holes. Therefore, to establish an electrical and mechanical connection between the wires and the terminal strips, a user first opens the top section (i.e., pivots the top section to its open position), inserts the pair of wires, and then closes the top section. Upon closing the top section of the connector, the wires are brought into electrical and mechanical contact with the terminal strips. To remove the wires and/or break the electrical connection, the process is reversed.

To verify the integrity of a telephone line, the telephone line may be tested at the connector. The size of a connector makes it difficult for a craftsperson to manipulate the connector without the risk of compromising the connection between the wire and the terminal strip within the connector. For this reason, conventional connectors have been designed to afford test access by providing test channels that are open at all times. In this way, the chance of disrupting the electrical connection during testing is minimized. The connector itself, however, is left vulnerable to elements, such as dust or other particles, that can damage the integrity of the connector and the electrical connection. To minimize potential damage to the connector, it is desirable to provide a connector that has test channels that minimize the ingression of elements that can damage the connector.

SUMMARY OF THE INVENTION

The present invention is directed at overcoming the shortcomings of the prior art. A connector can be provided that includes a housing having a top portion, a test channel formed in the housing, and a terminal strip, a portion of which is disposed within the test channel. A membrane is fixed to the top portion of the housing for substantially closing one end of the test channel to prevent contaminants from entering the test channel. The membrane is preferably formed of an elastic material and may have a very small aperture that communicates with the test channel but also essentially seals the test channel. In this way, unlike the conventional connector, which has test channels that are open to outside contaminants, the present connector is essentially sealed from outside contaminants.

A conventional testing device having a tapered test probe may be used to access the test channel either by piercing the membrane to create an aperture or by engaging the small aperture formed in the membrane with the test probe. In either case, the craftsperson presses the test probe into the test channel and the aperture formed in the membrane stretches to accommodate the test probes, thereby permit permitting the craftsperson to test the connector by contacting the terminal strip with the test probe. Preferably, the membrane is so formed as to be resilient enough to permit passage of the test probe therethrough, but possessed of sufficient shape memory to press against the probe when the probe is inserted and return to its original shape (having the very small aperture) when the probe is removed.

When the test probe is withdrawn from the test channel, the membrane returns to its original shape, which again prevents contaminants from entering the interior of the connector. Thus, in contrast to the prior art connector, the present invention prevents contamination of the connector before, during and after a test procedure has been performed on the connector, and provides easy access to the terminal strip to test the electrical connection of the connector.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Generally speaking, in accordance with the present invention, a connector testing system is provided that provides a more reliable testing configuration and a connector having improved protection.

Figure 4:
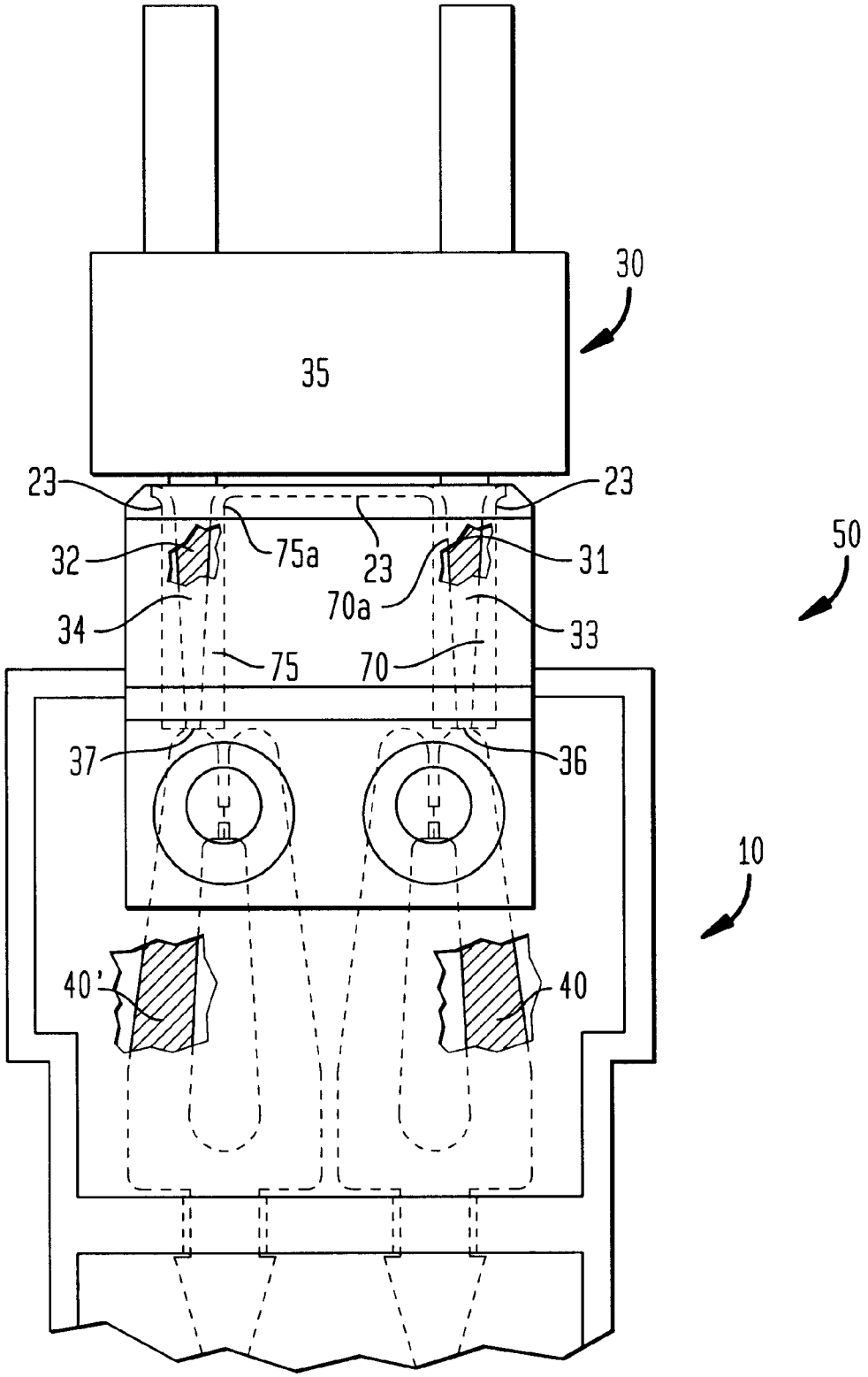
FIG. 4 is a front sectional view of the connector of FIG. 1 and a testing device for accessing a test channel of the connector at an inserted position.

Referring initially to FIG. 4, a connector testing system 50 includes a connector 10, having a pair of terminal strips 40, 40' and a housing 25, and a bridge clip 30. Terminal strips 40, 40' may be formed of any commonly known electrically conductive metal or electrical conductor known in the art and suitable for use in such terminals, such as, for example, platinum-washed phosphor bronze, or beryllium-copper alloy or any other material, metal or alloy combining good electrical conductivity with sufficient mechanical strength and resilience.

Figure 1:
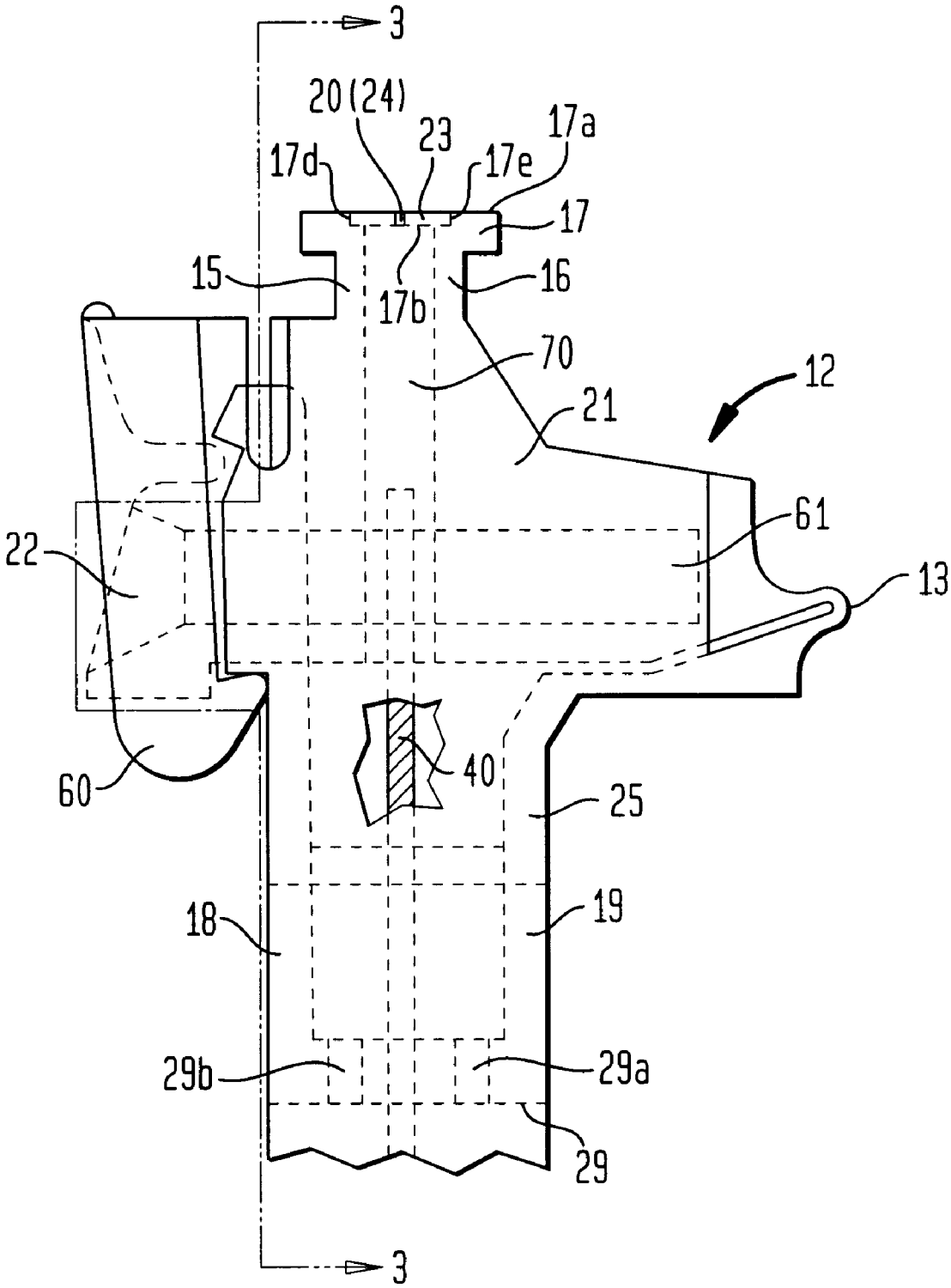
FIG. 1 is a side sectional view of the connector constructed in accordance with the present invention.
Figure 2:
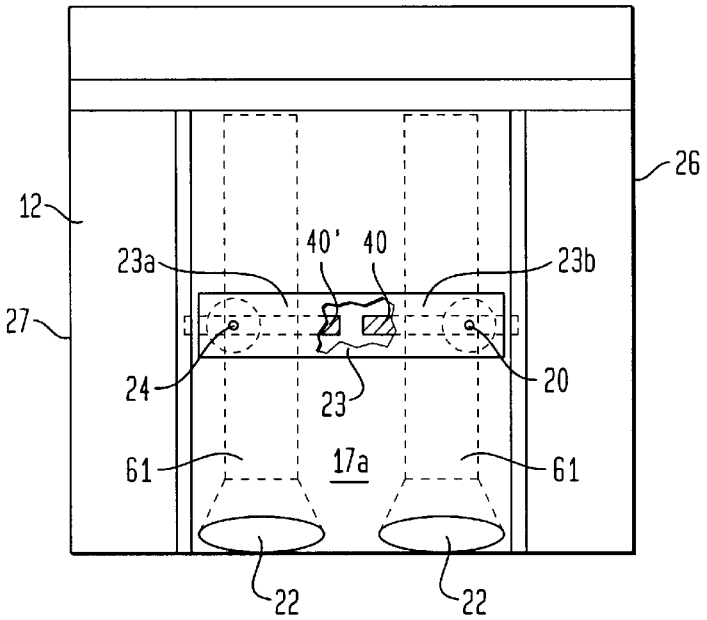
FIG. 2 is a top plan view of the connector of FIG. 1.
Figure 3:
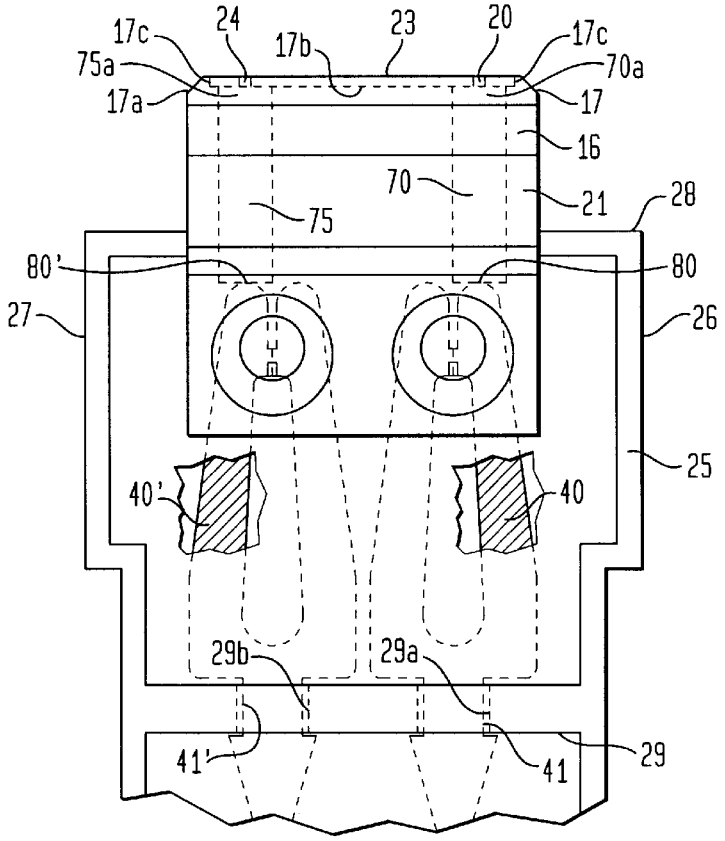
FIG. 3 is a front sectional view along line 3—3 of the connector of FIG. 1.

Referring to FIGS. 1–3, connector 10 includes a top portion 12, which is pivotably mounted to housing 25 about a hinge 13, and a clasp 60, which is selectively movable between an engaged position for engaging top portion 12 to housing 25 and a disengaged position (not shown). Housing 25 may be a single molded piece or consist of several molded pieces assembled together. For example, top portion 12 and housing 25 may be separate pieces or may be molded together as one piece having a living hinge. Top portion 12 includes a plinth 21, a base 16 that extends upwardly from plinth 21, and a flange 17, which extends outwardly from the top of base 16. Base 16 and flange 17 form a cap 15 preferably, but not necessarily, having a substantially t-shaped profile when seen from the side elevational view of FIG. 1. While cap 15 is shown as including flange 17, for the purpose of this invention, flange 17 need not extend outwardly from base 1*b*. In fact, flange 17 need not form a part of cap 15. Connector 10 has two entrance apertures 22 that lead to wire insertion holes 61. Wire insertion holes 61 are constructed so as to accept electrical conductors (not shown) in a manner known in the art. Connector 10 is preferably formed of a molded synthetic resinous material with good insulating properties and mechanical strength, e.g., a plastic. The specific materials utilized in constructing connector 10 are an application-specific matter of design choice within the knowledge of the person of skill familiar with wiring connectors and terminal blocks utilized in telephony.

Connector 10 also includes housing 25, which is constructed to accept the pair of terminal strips 40, 40' when top portion 12 is in the closed position as is shown in each of the figures.

Housing 25 includes a first side wall 26, a second side wall 27, a front wall 18 and a rear wall 19, extending between side walls 26, 27, and a top wall 28 and a bottom wall 29, each positioned substantially perpendicular to side walls 26, 27, front wall 18 and rear wall 19 and extending therebetween. Bottom wall 29 has throughholes 29*a*, 29*b* sized to accept snap fit recesses 41, 41' of terminal strips 40, 40', which are secured through the mating engagement of throughholes 29*a*, 29*b* and snap fit recesses 41, 41'. The specific means of affixing terminal strip 40 within connector housing 25 need not be solely by snap fitting as described above, but by numerous methods of affixation known in the art, such as by way of non-limiting example, adhesives, friction fitting, integral molding, screws, and the like, depending on whether ready removal and re-insertion of the terminal is required, as a matter of application-specific design choice.

Referring in particular to FIGS. 2 and 3, to facilitate testing of connections made in connector 10, test channels 70, 75 are formed in housing 25 to permit test leads to contact terminal strips 40, 40' at connector test point 80 and 80' respectively. A membrane 23 is fixed to flange 17 of connector 10 so as to substantially cover or close one end of test channels 70, 75. In this way, membrane 23 substantially seals access channels 70, 75 from outside contaminants.

Membrane 23 is preferably formed of an elastically deformable material, such as neoprene, rubber, or an other art-recognized resilient, flexible material. In short, the specific materials selected are an application-specific matter of design choice for the person of skill in the art, utilizing the teachings of the invention herein. Further, membrane 23 is preferably affixed by an adhesive to top portion 15, but may be fastened by any known affixation means in the art, such as, by way of non-limiting example, friction-fitting screws, snap-in tabs, and the like, as a matter of application-specific design choice. Referring to FIG. 2, membrane 23 is shown as having a substantially rectangular shape, but may be any shape. Further, membrane 23 need not be a single element; membrane 23 may be two or more spaced-apart elements such as first and second membrane members 23*a* and 23*b*. Preferably, membrane 23 is so formed as to be resilient enough to permit passage therethrough of test probe 31, for example, but possessed of sufficient shape memory to press against probe 31 when probe 31 is inserted and return to its original shape (having very small aperture 20) when probe 31 is removed.

In addition, membrane 23 may take a form other than that of a thin strip. For example, membrane 23 may be formed at the inlet of test channels 70, 75 by injecting a liquid material into the inlet of test channels 70, 75 that is permitted to harden to substantially seal test channels 70, 75. Separate membranes also may take the form of a grommet that can be press-fitted or inserted into the inlet of test channels 70, 75 to substantially seal test channels 70, 75.

In one embodiment, flange 17 includes a top surface 17*a* and membrane 23 is affixed to top surface 17*a*. In a preferred embodiment, as is best shown FIGS. 1 and 3, flange 17 is formed with a cavity or depression 17*b* having side walls 17*c*, a front wall 17*d* and a rear wall 17*e*. Membrane 23 is seated within depression 17*b* to prevent the inadvertent removal of membrane 23. Further, side walls 17*c* and front and rear walls 17*d*, 17*e* of depression 17*b* support and retain membrane 23 when, as described below, the test probes of bridge clip are inserted through membrane 23.

Membrane 23 preferably has a pair of test apertures 20, 24 that fluidly communicate with test channels 70, 75, respectively. Test apertures 20, 24 may be in the form of throughholes or slits. Alternatively, membrane 23 may be formed without a test aperture; that is, without a breach in membrane 23.

Figure 5:
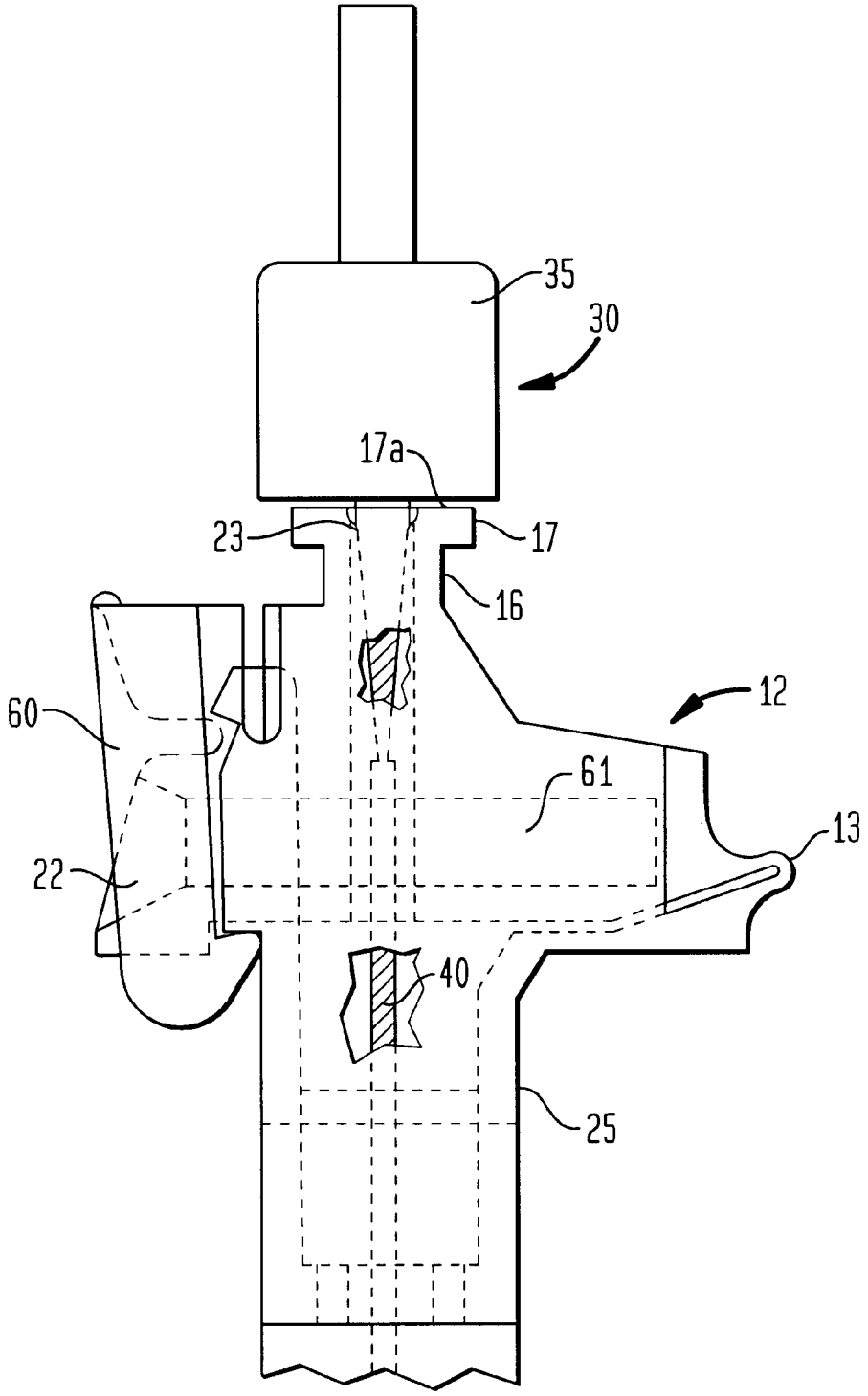
FIG. 5 is a side sectional view of the connector of FIG. 4.

Referring to FIGS. 4 and 5, a test tool 30 for testing connector 10 is depicted. Test tool 30 includes a body 35 and a pair of probes 31, 32, having respective tapered probe sections 33, 34. Tapered sections 33, 34 end respectively in tips 36, 37, which contact terminal strips 40, 40' when test tool 30 is inserted into test channels 70, 75. In one embodiment, the craftsperson uses test tool 30 to create test apertures 20, 24 in membrane 23 by piercing membrane 23, and then presses probes 31, 32 into test channels to contact terminal strips 40, 40'. In the alternative, the craftsperson may pierce membrane 23 to form test apertures 20, 24 by using any other standard tool, such as an awl, punch, drill or nail, by way of non-limiting example, prior to employing test tool 30.

Alternatively, where test apertures 20, 24 are formed in membrane 23, the craftsperson first engages apertures 20, 24 with tips 36, 37, and presses probes 31, 32 into test channels 70, 75 until probes 31, 32 contact terminal strips 40, 40'. As is shown in FIGS. 4 and 5, as tapered sections 33, 34 of probes 31, 32 pass through apertures 20, 24, apertures 20, 24 stretch to conformingly accommodate tapered sections 33, 34. In this way, membrane 23 permits access to test channels 70, 75, while substantially sealing the same test channels by pressing against tapered sections 33, 34 of probes 31, 32 during the testing procedure. When tips 36, 37 contact terminal strips 40, 40', membrane 23 stretches into inlets 70*a* and 75*a* of test channels 70, 75, and the craftsperson may test the wire connection at connector 10.

After testing the connection, the craftsperson withdraws test tool 30. As tapered sections 33, 34 are withdrawn from test apertures 20, 24, the test apertures substantially return to their original shape and condition, depending on the shape-memory characteristics of the material utilized to make membrane 23. That is, when test tool 30 is completely withdrawn from connector 10, membrane 23 preferably again functions to substantially seal test channels 70, 75 from outside contaminants.

Forming apertures 20, 24 in membrane 23 offers the advantage of controlling the size of the opening and thereby minimizing the likelihood that membrane 23 will be damaged during the testing procedure. Depending on the requirements of a specific application, however, the advantage of forming membrane 23 without an aperture so as to completely seal test channels 70, 75, may outweigh the need for the controlled expansion of apertures 20, 24 provided where apertures 20, 24 are formed in membrane 23 rather than where apertures 20, 24 are created by test tool 30 or a piercing tool.

In this way, unlike the prior art connector, which has test channels that are open to the exterior elements, the present configuration seals or substantially seals test channels 70, 75 prior to testing and during testing, and substantially seals test channels after testing connector 10. Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A connector, comprising:

a housing having an entrance aperture, a wire insertion hole and a test channel;

a terminal strip having a wire contact region;

said test channel providing a fluid communication path to said terminal strip that is distinct from said entrance aperture and said wire insertion hole;

a connector test point disposed on said terminal strip at a portion of said terminal strip disposed within said test channel and in spaced apart relation to said wire contact region within the test channel; and a membrane attached to the housing and over one end of the test channel to substantially seal the test channel from outside contaminants.

2. The connector of claim 1, wherein the membrane has a test aperture, the test aperture being in fluid communication with the test channel.

3. The connector of claim 2, wherein the membrane consists of an elastically deformable material.

4. The connector of claim 3, wherein the test aperture conformingly engages with an outer surface of a test probe passing therethrough to substantially seal the test channel from outside contaminants when the test probe is at a testing position.

5. The connector of claim 3, wherein the test aperture retains its original shape when the test probe no longer passes therethrough to substantially seal the test channel from outside contaminants.

6. The connector of claim 1, wherein the housing includes a top portion having a flange, and the membrane is attached to the top portion.

7. The connector of claim 1, wherein the housing includes a top portion having a depression sized to accept the membrane.

8. The connector of claim 1, wherein the membrane is formed of neoprene.

9. A connector, comprising:

a housing having a first entrance aperture, a first wire insertion hole, a second entrance aperture, a second wire insertion hole, a first test channel and a second test channel;

a first terminal strip having a first wire contact region;

a second terminal strip having a second wire contact region;

said first test channel providing a fluid communication path to said first terminal strip that is distinct from said first entrance aperture and said first wire insertion hole;

said second test channel providing a fluid communication path to said second terminal strip that is distinct from said second entrance aperture and said second wire insertion hole;

a first connector test point disposed on said first terminal strip at a portion of said first terminal strip disposed within said first test channel and in spaced apart relation to said first wire contact region within the first test channel;

a second connector test point disposed on said second terminal strip at a portion of said second terminal strip disposed within said second test channel and in spaced apart relation to said second wire contact region within the second test channel and spaced apart from the first connector test point; and at least one membrane attached to the housing so as to cover one end of each of the first and second test channels to at least substantially seal the first and second test channels.

10. The connector of claim 9, wherein said at least one membrane has a first membrane member and a second membrane member, the housing including a top portion having a first depression, sized to accept the first membrane member and a second depression sized to accept the second membrane member.

11. The connector of claim 9, wherein the at least one membrane has a first aperture in fluid communication with the first test channel and a second aperture in fluid communication with the second test channel, the first test aperture conformingly engaging with an outer surface of a first test probe passing therethrough to substantially seal the first test channel from outside contaminants when the bridge test probe is at a testing position, and the second test aperture conformingly engaging with an outer surface of a second test probe passing therethrough to substantially seal the second test channel from outside contaminants when the first and second test probes are at a testing position.

12. The connector of claim 10, wherein the first test aperture retains its original shape when the first test probe no longer passes through the first test aperture to substantially seal the first test channel from outside contaminants and the second test aperture retains its original shape when the second test probe no longer passes through the second test aperture to substantially seal the second test channel from outside contaminants.

13. A method of testing an electrical connection, comprising the steps of:

providing a connector having a housing, said housing having an entrance aperture, a wire insertion hole, and a terminal strip having a wire contact region, a test channel formed within the housing, said test channel providing a fluid communication path to said terminal strip that is distinct from said entrance aperture and said wire insertion hole, a connector test point disposed on said terminal strip at a portion of said terminal strip disposed within said test channel and in spaced apart relation to said wire contact region within the test channel and a membrane attached to the housing and over the test channel;

piercing a test aperture in the membrane; and inserting a test probe into the test channel to contact said wire contact region of said terminal strip and test the electrical connection.

14. The method of claim 13, comprising the step of removing the test probe from the test channel, to permit the membrane and the test aperture to substantially assume its original shape to substantially seal the test channel.

15. The method of claim 13, wherein the test probe has an outer surface and the membrane conformingly engages with the outer surface of the test probe as the test probe is inserted through the test aperture.

16. A method of manufacturing an insulation displacement connector, comprising the steps of:

providing a housing having an entrance aperture, a wire insertion hole and; a test channel, the test channel having a portion of a terminal strip having a wire contact region disposed therein, said test channel providing a fluid communication path to said terminal strip that is distinct from said entrance aperture and said wire insertion hole; and forming a membrane over an end of the test channel to substantially seal the test channel from outside contaminants.

* * * * *